US005291874A

United States Patent [19]

Harrison

[11] Patent Number: 5,291,874

[45] Date of Patent: Mar. 8, 1994

[54] TWO-PIECE, TAKE-DOWN, LAMINATED-LIMB BOW

[76] Inventor: Jack B. Harrison, 6314 Hampton Dr., Anchorage, Ak. 99504

[21] Appl. No.: 672,897

[22] Filed: Mar. 21, 1991

[51] Int. Cl.[5] ..... F41B 5/00

[52] U.S. Cl. ..... 124/23.1; 124/88; 29/447; 72/364; 403/345

[58] Field of Search ..... 124/23.1, 88; 29/447; 72/342.1, 364; 138/100, DIG. 11; 403/282, 285, 345, 247, 365, 265, 268; 43/18.1, 18.5

[56] References Cited

U.S. PATENT DOCUMENTS

| | | | |
|---|---|---|---|
| 169,181 | 10/1875 | Leonard | 43/18.1 X |
| 692,884 | 2/1902 | Lyon | 43/18.1 |
| 1,709,630 | 4/1929 | Rounsevelle | 124/23.1 |
| 1,810,335 | 6/1931 | Barnhart | 124/23.1 |
| 1,985,427 | 12/1934 | Richardson | 43/18.1 X |
| 2,000,832 | 5/1935 | Fisher | 124/23.1 |
| 2,073,418 | 3/1937 | Gille et al. | 124/23.1 |
| 2,600,629 | 6/1952 | Feierabond | 43/18.1 X |
| 3,170,721 | 2/1965 | Wells et al. | 43/18.1 X |
| 4,575,277 | 3/1986 | Dickey et al. | 43/18.1 X |

FOREIGN PATENT DOCUMENTS

| | | | |
|---|---|---|---|
| 135941 | 1/1950 | Australia | 124/23.1 |

*Primary Examiner*—Randolph A. Reese
*Assistant Examiner*—John Ricci

[57] ABSTRACT

A two-piece, laminated-limb, take-down bow and a process for making such a bow is described. In brief, the bow comprises: an upper laminated-limb, having a sight-window formed therein and an outer diameter defined under the sight-window; a metal female sleeve having an outer diameter larger than the diameter of the upper laminated-limb; a first amount of shock-absorbing epoxy residing between a portion of the interior of the metal female sleeve and the upper laminated-limb; a lower laminated-limb; a metal male sleeve having an outer diameter smaller than the inner diameter of the female sleeve and capable of slidable insertion therein; a second amount of shock-absorbing epoxy residing between a substantially all of the interior of the metal male sleeve and the lower laminated-limb.

29 Claims, 3 Drawing Sheets

TWO-PIECE, TAKE-DOWN, LAMINATED-LIMB BOW

BACKGROUND OF THE INVENTION

This invention relates generally to the art of archery and, more specifically, to the art of take-down bows using laminated-limbs.

Bows have been used in archery for centuries, and many innovations have been proposed to increase their performance. One need in the art has been for portability. The bow is quite long; and, therefore, there have been repeated attempts to design take-down bows that were more portable than the monolithic structure, but which were as fast-shooting and accurate.

One example of such an attempt is seen in U.S. Pat. No. 2,000,832, issued to Fisher, which disclosed a bow made from metal. The limbs are inserted into a handle structure of seamless tube steel, open at both ends to hold the shanks of the metal limbs. However, the Fisher structure has a number of problems, and it has not been accepted by archers. For example, the handle of Fisher is open on the top end, for receiving the upper limb, thus resulting in dirt, water, and other foreign materials being enabled to enter the opening. Those foreign materials scratch, gall, and corrode the socket, thus causing a non-uniform fit between the limb and handle. Further, the use of metal limbs causes the bow to be very heavy. Further still, having separate limbs and handle results in two joints, each of which must be exactly aligned if the bow is to shoot the same each time it is put together; and, there are three pieces that must be handled in assembly.

Another example of an attempt to make a take-down bow is seen in U.S. Pat. No. 1,709,630, issued to Rounsevelle. Unlike Fisher, Rounsevelle had a two-piece structure. However, Rounsevelle faced the same fouled joint and alignment problems of Fisher. In an attempt to address this problem, Rounsevelle provided a tapered two-sleeve fastener, each sleeve being attached permanently to one limb. However, each sleeve is tubular and the female sleeve is attached to the lower limb. Such an attachment has numerous disadvantages, among which is the tendency for the upward-pointing female sleeve to collect water, dirt, snow, etc. Further, the sleeve placement and tapering weakens the bow, limiting the size of the sight-window that can be cut in the upper limb. Further still, Rounsevelle does not provide for a close-tolerance fit to increase repeatability of the way in which the bow would shoot after being taken down and reassembled. Apparently, Rounsevelle did not recognize the need. Nor does Rounsevelle provide any way in which the metal surfaces of the sleeves can be protected from galling, corrosion, or other deterioration. Rounsevelle's bow, also, has not been accepted by archers.

Yet another attempt to make an acceptable take-down bow is seen in U.S. Pat. No. 2,073,418, issued to Gille, et al. Gille shows a metal-limbed bow with a "D-shaped" sleeve structure for aligning the metal-tube limbs; however, Gille has many of the previously mentioned problems. For example, due to the tubular nature of the limbs, there can be no provision for a deeply cut sight-window in the upper limb; and, the upper limb is inserted into the handle, thus creating an upward-pointing female sleeve. Further, Gille fails to disclose any way to prevent galling, corrosion, wear, etc. of the joints. Further still, Gille shows that the prior art intentionally placed the female sleeve on the lower limb of the take-down bows, in order to have the wider portion of the bow in the handle, thus allowing the top of the female sleeve to be used as an arrow rest. Gille's bow has not been accepted by archers.

Another take-down bow is seen in Australia Patent No. 135,941, issued to Brewer, which discloses yet another socket arrangement in which the female sleeve is mounted on the lower limb, causing the same problems discussed above. Further, Brewer teaches that the metallic socket members should be pinched or clamped to the wood limbs. Such an arrangement destroys the limbs due to compression of the soft wood by the hard metal, and has not been accepted.

Another metal-limbed, take-down bow is seen in U.S. Pat. No. 1,810,335, issued to Barnhart, which again teaches that non-metal bow limbs are undesirable. Also, Barnhart fails to address the above-noted problems; and, like the previously-mentioned bows, has not been accepted.

One of the more modern improvements in archery has been the advent of laminated-limbs. Such laminated-limbs allow for more uniformity in manufacture, better control, and faster shooting bows. However, the laminated-limbs suffer from the problem that they are soft. Also, they are as prone to damage in take-down bows as were wood limbs. Further, the laminated-limbs are of a different shape. The older wood and metal-tubed bows were rounded in the limbs, allowing for the use of tube-like sleeves for the joints; while, in modern laminated bows, the limbs are flattened, resulting in the necessity to fit a rectangular peg (the laminated-limb) in a substantially round hole (the tube) if the tubular sleeve of old are used. The art did not see such a solution as practical, and opted for rectangular-rectangular limb-to-riser connection means, using a metal-riser and two, separate laminated-limbs, as discussed below.

The advent of the metal-riser, in which the grip, arrow rest, and sight-window were incorporated, allowed the art to make the only take-down bows that, to date, have met with acceptance. Those metal-risers allowed for insertion of separate laminated upper and lower limbs, thus creating a three-piece, take-down bow. Since the riser was metal, and therefore strong, a deep sight-window could be cut therein, allowing the bow to cast the arrow more closely along the plane of the bow—that is, the plane in which the limbs tend to force the string. Such alignment improves the speed and accuracy of the bow. Further, the ends of the riser, above the sight-window and below the grip, could be shaped to conform to the rectangular shape of modern laminated-limbs.

Some three-piece, metal-riser take-downs, such as that made by Bear Archery, had rectangular pockets at each end of the riser into which the laminated-limbs were loosely inserted. Tension on the string forced each limb to stay in the riser. The first shot with such a bow was usually accompanied with a load gun-shot sound as the limbs "seated." The first shot was not considered to be accurate, due to the lack of seating. Some archers would half-draw the bow and release the string to seat the limbs before the first shot. The practice, understandably, was not considered to be conducive to long life for the bow. Further, in high draw-weight bows, the limbs tended to creak during the draw. Further, when the bow was shot, the limbs rattled in the pockets, resulting in loud, noisy bows——not well suited to hunting, where many animals react fast enough to move out of the way if they hear either the draw, or even the shot.

Other bow makers, also attempting to provide the portability of a take-down bow, still using metal-risers and separate upper and lower laminated-limbs, provided channels into which the butt of each limb was inserted. A bolt was inserted through the laminated-limb and into a support shelf located on the shooter's side of the riser. Thus, as the bow was drawn, the laminated-limb pressed against the shelf on the shooter's side of the riser. The channel wall on the target side of the riser held the limb in place. The bolt provided stability. Such a design was, effectively, the only design used by olympic-style (FITA) archers during the last three decades. Examples of such bows include the Hoyt (now Easton) TD-2 and TD-3, and the Yamaha bows that competed therewith, as will be understood by those of skill in the art. These bows included the same seating and noise problems associated with other three-piece, metal-riser, take-down bows.

An additional problem with the three-piece, metal-riser bows was the short limbs. Because the riser was stiff, no part of the riser could be used to impart energy to the arrow. All of the mechanical energy had to be stored in the relatively short laminated-limbs. The result was that take-down bows tended to shoot slowly.

The need for speed of arrow flight led to the development of what is now known as the compound bow. Such a bow is known to those of skill in the art as a cam-operated, cable bow, using a metal-riser and very short, but very thick, laminated-limbs. The overall length of such a bow is substantially shorter than the traditional one-piece bow, allowing somewhat for the portability desired in a take-down bow, and the compound shoots faster for the same draw weight in a three-piece take-down. However, it is fairly complex and cannot be easily unstrung and restrung with consistent accuracy.

Therefore, there is, and has long been, a need for a two-piece, take-down bow with shock absorbing qualities that can be made from modern, laminated-limbs and be assembled accurately, time after time. Also, there is a need for the two-piece, take-down bow to provide for a close tolerance fit, with resistance to galling, corrosion, fouled joints, and the like, while still providing a deeply cut sight-window, ease of set-up with repeatable performance between set-ups, and accuracy.

SUMMARY OF THE INVENTION

The above noted needs are addressed according to the present invention, by a two-piece, take-down bow using laminated-limbs, comprising: an upper laminated-limb, having a sight-window formed therein and an outer diameter defined under the sight-window; a female sleeve having an inner diameter larger than the outer diameter of the upper laminated-limb; a first amount of shock-absorbing epoxy residing between a portion of the interior of the female sleeve and the upper laminated-limb; a lower laminated-limb; a metal male sleeve capable of slidable insertion in the female sleeve; and a second amount of shock-absorbing epoxy residing between substantially all of the interior of the male sleeve and the lower laminated-limb.

According to another aspect of the invention, a process for making such a two-piece, take-down bow with laminated-limbs is provided comprising: inserting a stainless-steel tube into a brass alloy tube, wherein the brass alloy tube is hotter than the tube of stainless-steel; causing the temperature of the stainless-steel tube and the brass alloy tube to be substantially the same; flattening a portion of the brass alloy tube, whereby a substantially flat surface substantially parallel to the axis of the brass alloy tube is defined; forming two non-parallel lateral aspects in the outer diameter of the brass alloy tube, whereby the flattening of the portion of the brass alloy tube and forming in the outer diameter of the brass alloy tube define a brass alloy sleeve; flattening a portion of a stainless-steel tube, whereby a substantially flat surface substantially parallel to the axis of the stainless-steel tube is defined; forming two non-parallel lateral aspects in the outer diameter of the stainless-steel tube, wherein the flattening the portion of the stainless-steel tube and the forming in the outer diameter of the stainless-steel tube define a stainless-steel sleeve; inserting shock-absorbing epoxy between a portion of the interior of the brass alloy sleeve and an upper laminated-limb; and inserting shock-absorbing epoxy between substantially all of the interior of the stainless-steel sleeve and a lower laminated-limb.

DESCRIPTION OF THE DRAWINGS

For a more complete understanding of the present invention and for further advantages thereof, reference is made to the following Description of Embodiments of the Invention taken in conjunction with the accompanying Drawings, in which.

It is to be noted, however, that the appended drawings illustrate only typical embodiments of this invention and are therefore not to be considered limiting of its scope, for the invention may admit to other equally effective embodiments.

DETAILED DESCRIPTION OF EMBODIMENTS OF THE INVENTION

Figure 1:
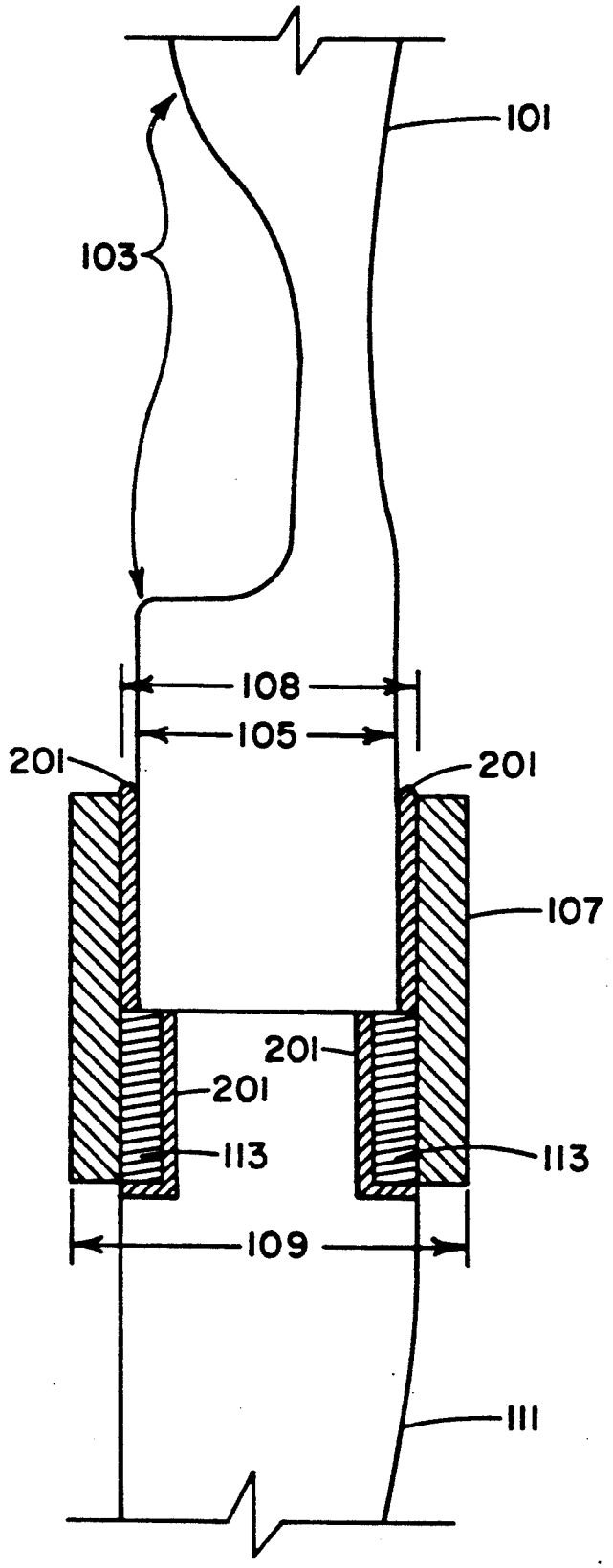
FIG. 1 is a cut-away view of a male-female sleeve arrangement used according to one embodiment of the present invention.

Referring to FIG. 1, there is shown a portion of an embodiment of the present invention. According to such an embodiment, there is provided a two-piece, take-down bow using laminated-limbs, comprising: an upper laminated-limb 101 having a sight-window 103 formed therein and an outer diameter 105 defined under the sight-window 103. Also provided is a metal female sleeve 107 having an inner diameter 108 larger than the outer diameter 105 of the upper laminated-limb 101. Also provided is a first amount of shock-absorbing epoxy 201 residing between a portion of the interior of the metal female sleeve 107 and the upper laminated-limb 101.

Also according to this embodiment, there is provided a lower laminated-limb 111 to which there is connected a metal male sleeve 113 capable of slidable insertion into the metal female sleeve 107. The metal male sleeve 113 is attached to lower laminated-limb 111 by a second amount of shock-absorbing epoxy 201 residing between substantially all of the interior of the metal male sleeve 113 and the lower laminated-limb 111.

Figure 2:
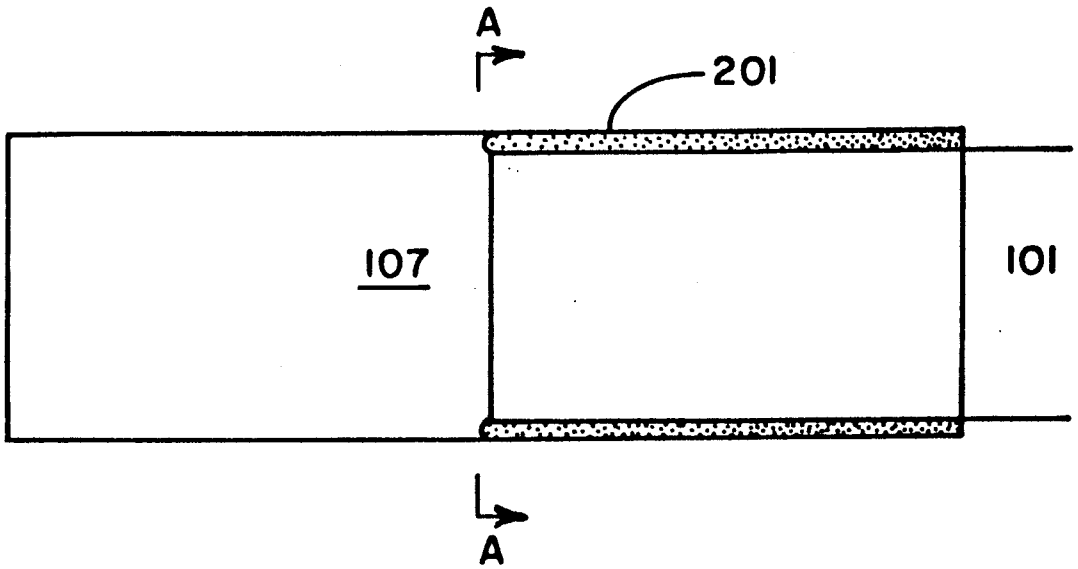
FIG. 2 is a side view of a sleeve arrangement used according to one embodiment of the present invention.
Figure 2A:
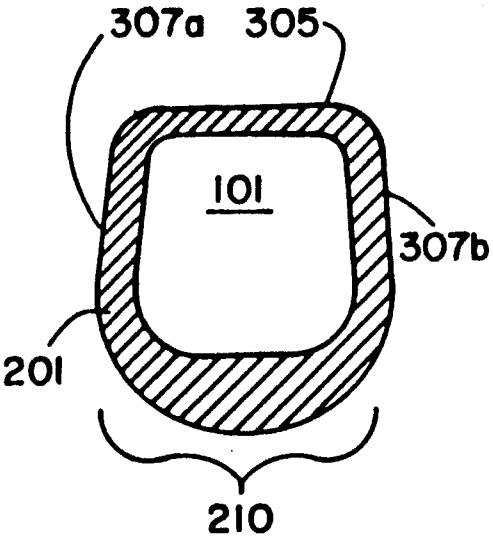
FIG. 2A is a cross section along line A—A of FIG. 2.
Figure 3:
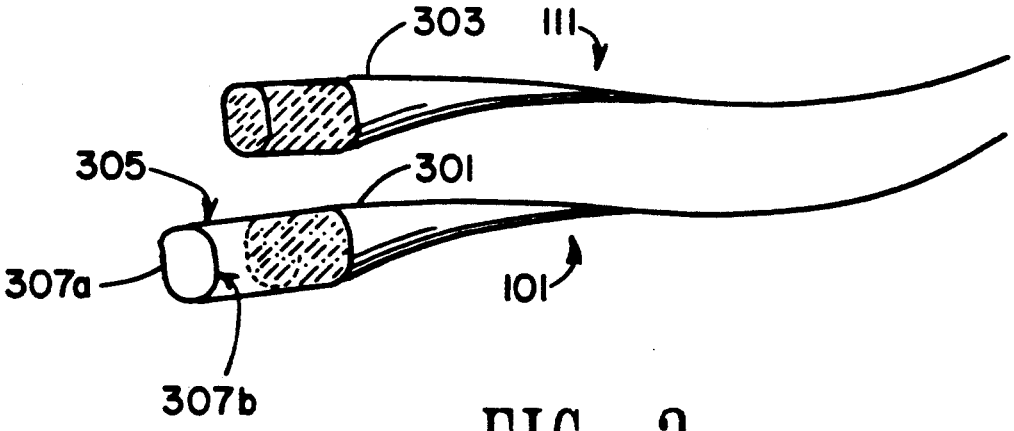
FIG. 3 is a perspective view of an upper and lower laminated-limb used according to an embodiment of the present invention.

According to a further embodiment of the invention, the upper laminated-limb 101 defines an upper laminated-limb bow back surface 301 (best seen in FIG. 3); and, metal female sleeve 107 further comprises a substantially flat surface 305 (also seen in FIG. 2), which is positioned and arranged to be substantially parallel to the back surface 301. This embodiment further includes a pair of lateral aspects 307*a* and 307*b* (best seen in FIG. 2), which are connected to the substantially flat surface 305 and are arranged at non-perpendicular angles to the substantially flat surface 305. The metal female sleeve 107 further comprises a curved belly portion 210 (best seen in FIG. 2) connected between the pair of lateral aspects 307*a* and 307*b*, wherein the curved belly portion 210 is wider than the flat surface 305.

According to yet a further embodiment of the invention, metal male sleeve 113 comprises seamless, jeweled, 300-series, blued stainless-steel. Further, in accordance with an embodiment of the invention, the female sleeve 107 is between about 4 inches and about 6 inches in length, and the male sleeve 113 is between about 2 inches and about 3 inches in length. According to one embodiment, the male sleeve is about one-half the length of the female sleeve.

Figure 4:
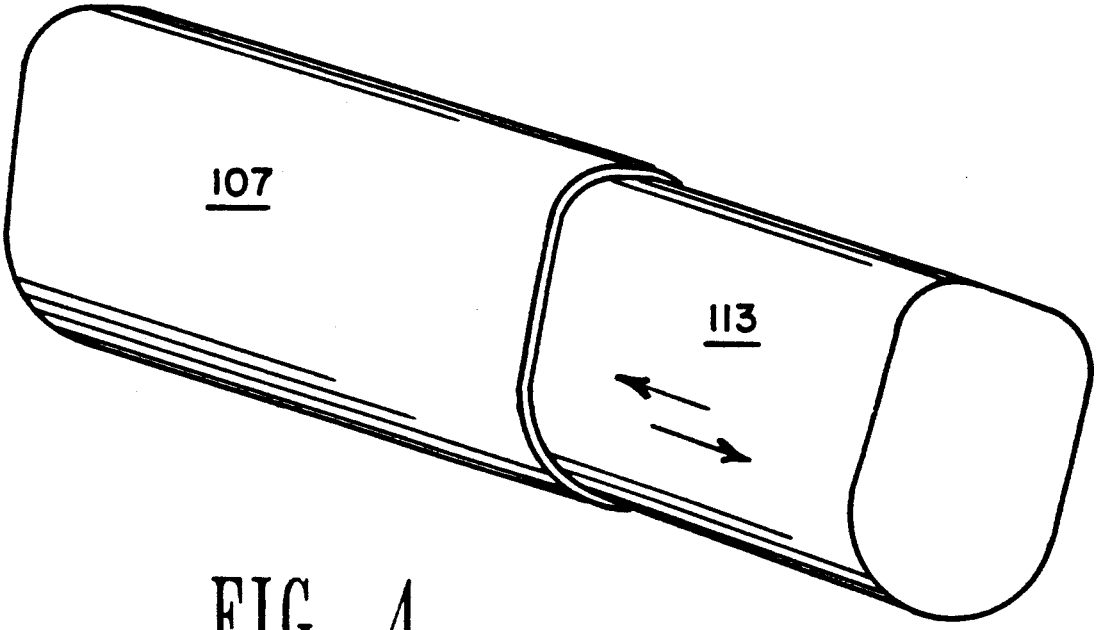
FIG. 4 is perspective view of a male-female sleeve arrangement used according to one embodiment of the present invention.

According to a further aspect of the present invention, a process for making a two-piece, take-down, laminated-limb bow is provided. Referring now to FIG. 4, stainless-steel tube 113 is seen being inserted into brass alloy tube 107. The temperature of brass alloy tube 107 is increased above that of stainless-steel tube 113, in order for stainless-steel tube 113 to stretch brass alloy tube 107. Substantially flat surface 305 (FIG. 2) is formed in brass alloy tube 107 while stainless-steel tube 113 resides therein. Further, non-parallel aspects 307*a* and 307*b* (FIG. 2) are also formed (for example, by a die in a hydraulic press) while stainless-steel tube 113 resides in brass alloy tube 107. Thus, belly portion 210 is formed to be wider than substantially flat surface 305, and female sleeve 107 and male sleeve 113 have a close-tolerance fit.

To further increase the close-tolerance fit between sleeve 107 and sleeve 113, the two sleeves 107 and 113 are subjected to a process of heat-shrink fitting. According to such a process, sleeve 107 is repeatedly heated and water quenched. Due to the differences in expansion coefficients between the brass alloy of sleeve 107 and the stainless-steel of sleeve 113, the repeated heating and cooling creates a close fit. According to one embodiment, the process continues until the two sleeves 107 and 113 are separated by the force of gravity.

According to a further embodiment of the invention, the sleeve 107 is attached to upper laminated-limb 101 (FIG. 3) by aligning the flattened surface 305 with a substantially flat portion 303 of upper laminated-limb 101 and inserting the laminated-limb 101 into sleeve 107. The two are secured by gluing the inserted limb 101 to sleeve 107 with an anaerobic adhesive. Next, a shrinkless, shock-resistant filler epoxy is inserted between sleeve 107 and limb 101.

According to a further embodiment of the invention, stainless-steel sleeve 113 is attached to lower laminated-limb 111 in a similar process, as will be understood by those of skill in the art, based on the above disclosure.

One advantage of placement of the female sleeve 107 on upper limb 101 is that the larger diameter female sleeve 107 captures and holds more riser and limb material than the smaller diameter male sleeve. Hence, there the upper limb is stronger, allowing for a deeper cut to be made for the sight-window 103. Further, attaching the female sleeve to the upper limb lessens the amount of moisture and debris (e.g., dust) that can collect in the cup formed by the female sleeve, which would foul the joint formed by the male and female sleeves.

By combining seamless brass in the female sleeve with the seamless stainless-steel male sleeve, a superior, safe and durable bow limb fastener is made. The seamless brass alloy is considered superior for this invention to seamed brass tubing or any cast alloy (for example, common ferrous or aluminum tubing), because seamless brass tubing is stronger and safer than seamed brass tubing, or aluminum. Seamless brass tubing is manufactured with greater tolerances than seamed brass tubing, or aluminum. Further, seamless brass tubing is work-hardened and, therefore, tougher than seamed brass tubing, or aluminum. Further still, brass provides far less galling due to its metallurgical properties of natural lubrication when used with stainless-steel. Brass alloy is preferred due to its particular heat-responding properties; and seamless brass tubing responds well in dies, which are used according to one embodiment, to form the brass and stainless-steel tubes into the female and male sleeves. Aluminum has been found to be more brittle.

Seamless stainless-steel tubing is preferred, according to an embodiment, over seamed tubing or cast alloy of steel or aluminum, because seamless stainless-steel is: (1) stronger than seamed steel, (2) extruded, and therefore work-hardened; (3) less likely to gall than seamed stainless-steel; and (4) manufactured with greater tolerances than seamed stainless. Further, seamless stainless-steel responds better in the die in the sleeve shape formation process better than seamed steel tubing or aluminum.

The combination of brass and stainless-steel has been found to produce the most durable and corrosion-free bow-limb sleeve fastener tested. Compared to either common ferrous alloy or aluminum sleeve fasteners tested, the brass and stainless-steel combination proved superior under actual field conditions.

A further aspect of the invention providing an advantage is the shape of the sleeves. According to the above-described embodiments, the belly portion of the female sleeve is wider than the flat surface (also described herein as a "flat-facet"). The flat surface area in the sleeve is designed to overlay the riser and laminated-limb material. The flat-facet, therefore, not only enhances orientation for bow-limb alignment, but the flat-facet also creates a broad, flatter face to make a stronger glue-joint with the flat laminated-limb. This extra strength occurs because of the flat surface area contact between the sleeve and the limb materials. The flat-facet provides for a flat surface to come in contact with the lamination material and the bow-limb in the setup, fixing phase of attachment.

According to one embodiment, half of the female sleeve and all of the male sleeve become attached, using adhesives, to their corresponding limbs. According to such an embodiment, the initial fixing phase attaches the limbs to the sleeves using an anaerobic Loc-Tite 304 with lock-tight 707 activator to hold the limbs in perfect alignment with their corresponding sleeves. The next, or "filling," phase uses a Bronnell, shrinkless, shock-resistant filler epoxy (for example, Accraglass I) to fill-in the "void" between the ID of the sleeves and bow-limbs. Such a process may be termed "fix and fill"

in attaching the sleeves to the limbs. A further advantage is that the flat-facet eliminates the need to remove lamination material from the limb to accommodate sleeve fit.

It should be noted that sleeves in the prior art, discussed above, (a/k/a "radius style sleeves") originally appeared on bows having no bow-backing lamination of any kind (for example, fiberglass, graphite laminations, etc., currently used today as is known by those of skill in the art). Use of a radius style sleeve as seen in the prior art would require removal of the bow-backing to fit the squared, laminated-limb into the radius of the tube. However, it is desirable to retain as much of the bow-backing material as possible. Therefore, the flat-facet allows for retention of the bow-backing lamination under the sleeve, thereby allowing the sight-window to be cut, while still resulting in a strong and safe limb.

A further advantage of one aspect of this invention is seen in the flaring of the lateral aspects, whereby the lateral aspects are attached to the flat surface of the sleeve such that the belly portion of the sleeve is wider than the flat-surface. This also allows for enhanced strength and deeper sight-window cut. Further, the radius of the belly-side, due to the flaring, is longer than it would be without the flaring. This causes the angle of the bow to be less acute in angle, thus allowing for increased comfort, due to the fact that the belly portion bears all of the draw bow weight that the shooter experiences between the thumb and forefinger.

A further advantage of an embodiment of the invention is the jeweling on the male, stainless-steel sleeve. Such jeweling is done to enhance fit and capture minute amounts of lubrication that may be applied to the joint.

Yet a further advantage of an embodiment of the invention is the carbonization or oxidation on the male sleeve, commonly referred to as bluing. Such bluing case-hardens the surface of 300-series seamless stainless-steel (for example, 304 stainless). The hardened surface area enhances fit as a result of reduced galling between the stainless steel and the brass alloy used in the female sleeve.

It should be noted that according to one process for manufacture of the invention, a tool die that simultaneously shapes both male and female sections is used, whereby to make the male and female sleeves fit without voids between the walls (in other words, between the female ID and the male OD), heat shrinking is employed. According to such heat shrinking, the female brass sleeve is heated up until it expands to allow the cool male stainless-steel sleeve to simply drop inside. As the brass cools around the stainless section, the stainless section shrinks. After the entire unit is cool, it is shaped in the die under the pressure of the hydraulic press. To remove the male section from the female section after shaping into the desired shape, heat is once again applied. The male sleeve drops out because of the difference in expansion characteristics between brass and stainless steel. If at any point the male section hangs-up in the female section, one simply quenches the assembly in cool water. The brass shrinks again to conform to the hang-up, and, when reheated, the brass allows the stainless steel male section to pass. Thus, by alternating between heating and quenching in water, the male section can be gravity-forced to fall out of the brass section. Extremely close tolerances are thus achieved using this method.

Further embodiments and advantages thereof, in addition to the above-described embodiments and advantages will occur to those of skill in the art. Accordingly, the above are given by way of example only and not intended as limitations on the scope of the following claims.

What is claimed is:

1. A two-piece, take-down bow using laminated-limbs, comprising:
   - an upper laminated-limb, having a sight-window formed therein and an outer diameter defined under the sight-window;
   - a metal female sleeve having an inner diameter larger than the outer diameter of the upper laminated-limb;
   - a first amount of shock-absorbing epoxy residing between a portion of the interior of said metal female sleeve and said upper laminated-limb;
   - a lower laminated-limb;
   - a metal male sleeve capable of slidable insertion in said female sleeve; and
   - a second amount of shock-absorbing epoxy residing between substantially all of the interior of said metal male sleeve and said lower laminated-limb.

2. A bow as in claim 1 wherein said metal female sleeve comprises a brass alloy.

3. A bow as in claim 2 wherein said metal male sleeve comprises stainless-steel.

4. A bow as in claim 3 wherein said metal male sleeve comprises seamless stainless-steel.

5. A bow as in claim 4 wherein said metal male sleeve comprises a jeweled metal male sleeve.

6. A bow as in claim 5 wherein said metal male sleeve comprises seamless 300 series stainless-steel.

7. A bow as in claim 4 wherein said metal male sleeve comprises a blued metal male sleeve.

8. A bow as in claim 1:
   - wherein said upper laminated-limb defines an upper laminated-limb back surface; and
   - wherein said metal female sleeve further comprises:
     - a substantially flat surface positioned and arranged to be substantially parallel to said upper laminated-limb back surface; and
     - a pair of lateral aspects,
       - connected to said substantially flat surface arranged at non-perpendicular angles to said substantially flat surface.

9. A bow as in claim 8 wherein said metal female sleeve further comprises:
   - a curved belly portion, connected between said pair of lateral aspects,
   - wherein said curved belly portion is wider than said flat surface.

10. A bow as in claim 9:
   - wherein said metal male sleeve comprises seamless, jeweled, 300-series, blued, stainless-steel;
   - wherein said female sleeve is between about four inches and about six inches in length;
   - wherein said male sleeve is between about two inches and about three inches in length.

11. A process for manufacturing a two-piece, take-down, laminated-limb bow comprising the steps of:
   - inserting a stainless-steel tube into a brass alloy tube, wherein the brass alloy tube is hotter than the tube of stainless-steel;
   - causing the temperature of the stainless-steel tube and the brass alloy tube to be substantially the same;

flattening a portion of the brass alloy tube, whereby a substantially flat surface substantially parallel to the axis of the brass alloy tube is defined;

forming two non-parallel lateral aspects in the outer diameter of the brass alloy tube, whereby said flattening the portion of the brass alloy tube and forming two non-parallel lateral aspects in the outer diameter of the brass alloy tube define a brass alloy sleeve;

flattening a portion of a stainless-steel tube, whereby a substantially flat surface substantially parallel to the axis of the stainless-steel tube is defined;

forming two non-parallel lateral aspects in the outer diameter of the stainless-steel tube, wherein said flattening the portion of the portion of the stainless-steel tube and said forming two non-parallel lateral aspects in the outer diameter of the stainless-steel tube define a stainless-steel sleeve;

attaching the brass alloy sleeve to a first laminated bow limb; and attaching the stainless-steel sleeve to a second laminated bow limb.

12. A process as in claim 11 wherein said inserting comprises:

heating the brass alloy tube;

expanding the brass alloy tube; and inserting the stainless-steel tube into the brass alloy tube.

13. A process as in claim 11 further comprising:

removing the stainless-steel sleeve from the brass alloy sleeve after said forming two non-parallel lateral aspects in the outer diameter of the stainless-steel tube and before said attaching the stainless-steel sleeve to a laminated bow limb.

14. A process as in claim 13 wherein said removing comprises:

heating the brass alloy sleeve; and extracting the stainless-steel sleeve from the brass alloy tube.

15. A process as in claim 13 wherein said removing comprises:

repeatedly heating and cooling the brass alloy sleeve; and extracting the stainless-steel sleeve from the brass alloy sleeve.

16. A process as in claim 15 wherein said extracting comprises allowing the stainless-steel sleeve to slide out of the brass alloy sleeve under the force of gravity.

17. A process as in claim 15 wherein said extracting comprises allowing the brass alloy sleeve to slide from the stainless-steel sleeve by the force of gravity.

18. A process as in claim 15 wherein said cooling comprises water quenching.

19. A process as in claim 11 further comprising heat-shrink fitting of the stainless-steel tubing and the brass alloy tubing.

20. A process as in claim 11 wherein said attaching the brass alloy sleeve to the first laminated bow limb comprises:

aligning the flattened portion of the brass alloy sleeve with a substantially flat portion of the first laminated bow limb;

inserting the aligned first laminated bow limb into a laminated-limb portion of the brass alloy sleeve; and securing the inserted-aligned first laminated bow limb to the laminated-limb portion of the brass alloy sleeve.

21. A process as in claim 20 wherein said securing comprises:

fixing the inserted first laminated bow limb to the laminated-limb portion of the brass alloy sleeve; and filling between the laminated-limb portion of the brass alloy sleeve and the first laminated bow limb.

22. A process as in claim 21 wherein said fixing comprises gluing the inserted laminated bow limb to the laminated-limb portion of the brass alloy sleeve with an anaerobic adhesive.

23. A process as in claim 21 wherein said filling comprises inserting shrinkless, shock resistant filler epoxy between the brass alloy sleeve and the first laminated bow limb.

24. A process as in claim 11 wherein said attaching the stainless-steel sleeve to the second laminated bow limb comprises:

aligning the flattened portion of the stainless-steel sleeve with a substantially flat portion of the second laminated bow limb;

inserting the aligned second laminated bow limb into a laminated-limb portion of the stainless-steel sleeve; and securing the inserted-aligned second laminated bow limb to the laminated-limb portion of the stainless-steel sleeve.

25. A process as in claim 24 wherein said securing comprises:

fixing the inserted second laminated bow limb to the laminated-limb portion of the stainless-steel sleeve; and filling between the laminated-limb portion of the stainless-steel sleeve and the second laminated bow limb.

26. A process as in claim 25 wherein said fixing comprises gluing the inserted second laminated bow limb to the laminated-limb portion of the stainless-steel sleeve with an anaerobic adhesive.

27. A process as in claim 25 wherein said filling comprises inserting shrinkless, shock resistant filler epoxy between the stainless-steel sleeve and the second laminated bow limb.

28. A process as in claim 11 wherein said attaching the brass alloy sleeve to a laminated bow limb comprises:

aligning the flattened portion of the brass alloy sleeve with a substantially flat portion of the first laminated bow limb, inserting the aligned first laminated bow limb into a laminated-limb portion of the brass alloy sleeve, gluing the inserted first laminated bow limb to the laminated-limb portion of the brass alloy sleeve with an anaerobic adhesive, inserting shrinkless, shock resistant filler epoxy between the brass alloy sleeve and the first laminated bow limb, and wherein said attaching the stainless-steel sleeve to a laminated bow limb comprises:

aligning the flattened portion of the stainless-steel sleeve with a substantially flat portion of the second laminated bow limb, inserting the aligned second laminated bow limb into a laminated-limb portion of the stainless-steel sleeve, gluing the inserted second laminated bow limb to the laminated-limb portion of the stainless-steel sleeve with an anaerobic adhesive, and inserting shrinkless, shock resistant filler epoxy between the stainless-steel sleeve and the second laminated bow limb.

29. A process for manufacturing a two-piece, take-down bow comprising the steps of:

heating a brass alloy tube, expanding the brass alloy tube, and sliding a stainless-steel tube into the brass alloy tube, causing the temperature of the stainless-steel tube and the brass alloy tube to be substantially the same;

flattening, while the stainless-steel tube is still inserted in the brass alloy tube, a portion of the brass alloy tube, whereby a substantially flat surface substantially parallel to the axis of the brass alloy tube is defined in the brass tube, and whereby a second substantially flat surface is defined in the stainless-steel tube substantially parallel to the axis of the stainless-steel tube;

forming, while the stainless-steel tube is still inserted in the brass alloy tube, a first pair of non-parallel lateral aspects in the outer diameter of the brass alloy tube, whereby a second pair of non-parallel lateral aspects are defined in the outer diameter of the stainless-steel tube, whereby said flattening and forming define a brass alloy sleeve and a stainless-steel sleeve, repeatedly heating and water quenching the brass alloy tube until the brass alloy tube and the stainless-steel tube separate under the force of gravity;

aligning the first substantially flat surface with a substantially flat portion of the laminated bow limb;

inserting the aligned laminated bow limb into a laminated-limb portion of the brass alloy sleeve;

gluing the inserted laminated bow limb to the laminated-limb portion of the brass alloy sleeve with an anaerobic adhesive;

inserting shrinkless, shock resistant filler epoxy between the brass alloy sleeve and the laminated bow limb;

aligning the second substantially flat surface with a substantially flat portion of the laminated bow limb;

inserting the aligned laminated bow limb into a laminated-limb portion of the stainless-steel sleeve;

gluing the inserted laminated bow limb to the laminated-limb portion of the stainless-steel sleeve with an anaerobic adhesive; and inserting shrinkless, shock resistant filler epoxy between the stainless-steel sleeve and the laminated bow limb.

* * * * *